United States Patent [19]

Shimizu et al.

[11] Patent Number: 5,016,443

[45] Date of Patent: May 21, 1991

[54] FUEL-AIR PREMIXING DEVICE FOR A GAS TURBINE

[75] Inventors: Nobuo Shimizu; Michio Kuroda; Seiichi Kirikami; Isao Sato; Osamu Arai, all of Hitachi, Japan

[73] Assignee: Hitachi, Ltd., Tokyo, Japan

[21] Appl. No.: 404,314

[22] Filed: Sep. 7, 1989

[30] Foreign Application Priority Data

Sep. 7, 1988 [JP] Japan ..... 63-223819

[51] Int. Cl.[5] ..... F02C 3/14

[52] U.S. Cl. ..... 60/737; 60/746; 60/39.23

[58] Field of Search ..... 60/737, 739, 748, 742, 60/743, 740, 746, 261, 741

[56] References Cited

U.S. PATENT DOCUMENTS

| | | | |
|---|---|---|---|
| 3,035,410 | 5/1962 | Foulon | 60/739 |
| 3,151,453 | 10/1964 | Lefebvre et al. | 60/739 |
| 3,153,323 | 10/1964 | Hamm | 60/739 |
| 3,158,998 | 12/1964 | Robinson et al. | 60/739 |
| 3,213,523 | 10/1965 | Boehler | 60/739 |
| 3,703,259 | 11/1972 | Sturgess et al. | 60/748 |
| 3,793,838 | 2/1974 | Nash | 60/261 |
| 4,112,676 | 9/1978 | De Corso | 60/737 |
| 4,263,780 | 4/1981 | Stettler | 60/737 |
| 4,426,841 | 1/1984 | Cornelius et al. | 60/748 |
| 4,499,735 | 2/1985 | Moore et al. | 60/739 |

FOREIGN PATENT DOCUMENTS

| | | |
|---|---|---|
| 169431 | 1/1986 | European Pat. Off. . |
| 269825 | 6/1988 | European Pat. Off. . |
| 110506 | 1/1985 | Japan . |

*Primary Examiner*—Louis J. Casaregola
*Assistant Examiner*—Timothy S. Thorpe
*Attorney, Agent, or Firm*—Antonelli, Terry, Stout & Kraus

[57] ABSTRACT

A fuel-air premixing device of a gas turbine has a double-cylinder structure composed of an inner cylinder and an outer cylinder defining therebetween flow passages such that a fuel is supplied into air flowing through the passages so that a pre-mixture of the fuel and air is formed and discharged. The premixing device further has a plurality of radially spaced fuel nozzles capable of supplying the fuel into the passages, and fuel supply rate regulator valves for independently controlling the rates of supply of the fuel from the radially spaced nozzles.

3 Claims, 3 Drawing Sheets

FUEL-AIR PREMIXING DEVICE FOR A GAS TURBINE

BACKGROUND OF THE INVENTION

The present invention relates to a fuel-air premixing device for a gas turbine, particularly for a gas turbine which is operates at a high gas temperature.

A known fuel-air premixing device for a gas turbine is disclosed in Japanese Patent Laid-Open No. 61-22127 which corresponds to the U.S. patent application Ser. No. 144,646, now U.S. Pat. No. 4,898,001, which was a Continuation application of U.S. application Ser. No. 752,680, now abandoned. This known premixing device has a plurality of bar-like fuel nozzles arranged circularly. The fuel emitted from these nozzles is gasified and mixed with combustion air so that a premixture of the fuel and air mixed at a moderate ratio and in good state is discharged from the outlet of the premixing device.

This known premixing device suffers from a problem in that, when the capacity of the premixing device is increased to suppress emission of NOx from a gas turbine incorporating this premixing device, a non-uniform flowing velocity distribution is developed in the radial direction at the outlet of the premixing device, with the result that the desired uniform distribution of concentration of fuel cannot be obtained. Another problem is that the premixing device of the type described has a practical limit in the reduction of the air supply rate. Namely, it is difficult to reduce the air supply rate when the fuel supply rate is decreased to meet a demand for light-load operation of the gas turbine. In consequence, the fuel-to-air ratio is decreased to cause an air-excess ratio to increased impractically, often resulting in troubles such that the flame in the premixing device becomes unstable and it might be blown out in the worst case.

SUMMARY OF THE INVENTION

Accordingly, an object of the present invention is to provide a fuel-air premixing device for a gas turbine which enables the fuel-to-air ratio to be optimumly controlled while uniformizing the radial distribution of the air flow velocity and, hence, the fuel concentration distribution at the outlet of the premixing device, thereby overcoming the above-described problems of the prior art.

To this end, according to the present invention, there is provided a fuel-air premixing device of a gas turbine having a double-cylinder structure composed of an inner cylinder and an outer cylinder defining therebetween flow passages such that a fuel is supplied into air flowing through the passages so that a premixture of the fuel and air is formed and discharged, the premixing device further having a plurality of radially spaced fuel nozzles capable of supplying the fuel into the passages, and fuel supply rate regulator valves for independently controlling the rates of supply of the fuel from the radially spaced nozzles.

Thus, the fuel-air premixing device of the present invention has a plurality of fuel nozzles arranged at an interval in the radial direction of the premixing device. By adequately controlling the rates of supply of fuel from independent nozzles, it is possible to optimumly control the radial distribution of the fuel concentration at the outlet of the premixing device. More specifically, the fuel concentration is uniformizing in the radial direction at the outlet of the premixing device when the gas turbine operates at 100% load, whereas, when igniting the premixture by a pilot flame, the fuel concentration is increased in the region near the pilot flame thereby ensuring safe ignition. During partial-load operation of the gas turbine, a uniform radial distribution of the fuel concentration may impair stable burning of the premixture because such a uniform radial distribution of fuel concentration undesirably reduces the fuel-to-air ratio. In such a case, therefore, the radial distribution of the fuel concentration is so controlled as to form a local region of high fuel concentration thereby ensuring stable burning of the pre-mixture.

The fuel-air premixing device of the invention thus offers a stable burning of the pre-mixture while suppressing generation of NOx over the entire load region of the gas turbine.

DESCRIPTION OF THE PREFERRED EMBODIMENTS

Figure 1:
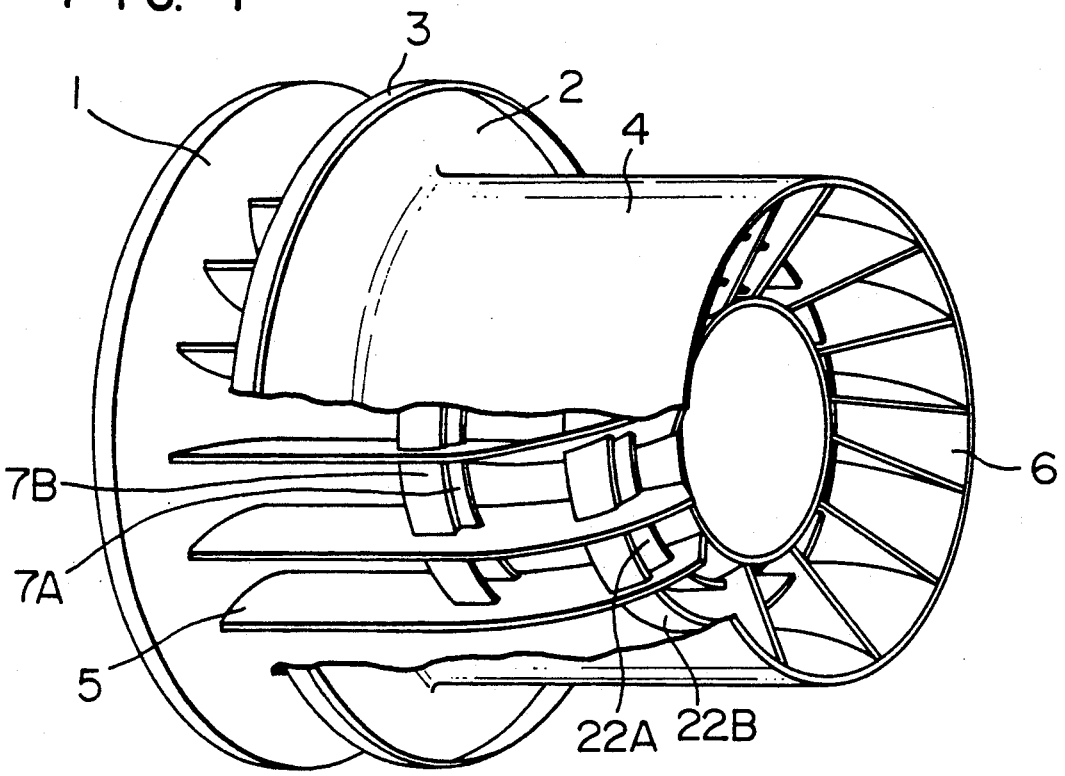
FIG. 1 is a partly cut-away perspective view of an embodiment of the premixing device of the present invention.
Figure 2:
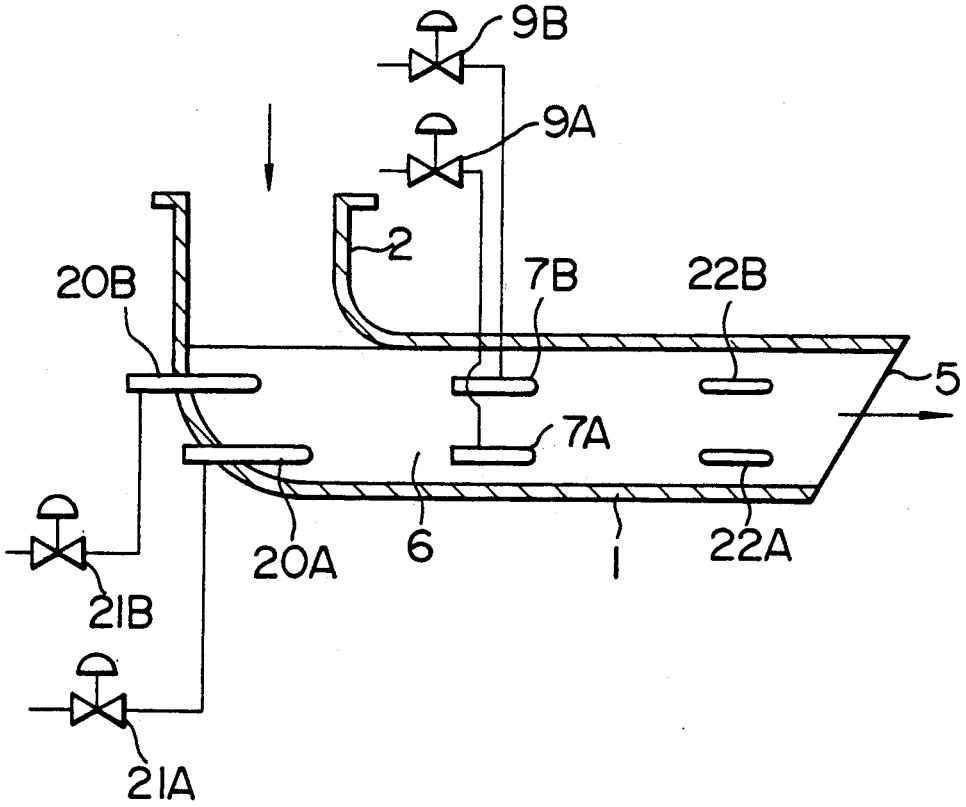
FIG. 2 is an enlarged sectional view of an essential portion of the premixing device shown in FIG. 1.

Referring to FIGS. 1 and 2, a first embodiment of the fuel-air premixing device of the present invention has a double cylinder structure having an inner cylinder 1 and an outer cylinder 2, with a radially diverging flare portion 3 and an axial portion 4. A plurality of slightly twisted vanes 5 are disposed between the inner and outer cylinders 1 and 2 so as to define a plurality of slightly twisted passages 6. In operation, air is introduced radially inward through the flare portion 3 so as to flow through the passages 6. Thus, the air introduced through the flare portion 3 is made to flow through the passages 6 which are defined by the inner cylinder 1, outer cylinder 2 and the vanes 5.

A pair of fuel nozzle rings, i.e., a radially inner fuel nozzle ring 7A and a radially outer fuel ring 7B are disposed between the inner cylinder 1 and the outer cylinder 2. As will be seen from FIG. 3, each fuel nozzle ring 7A, 7B has nozzle ports 8A, 8B and 8C which are directed so as to emit a fuel radially outward, axially forwardly and radially inward.

The sizes of the nozzle ports 8A, 8B and 8C of each fuel nozzle ring 7A, 7B can be determined such that the radial distribution of the fuel concentration at the outlet of the premixing device is optimized for a specific operating condition. It will be clear to those skilled in the art that the nozzle ports 8A, 8B and 8C may be directed so as to emit the fuel in directions other than mentioned above. It is thus possible to obtain an optimum radial distribution of the fuel concentration at the outlet of the premixing device for a specific condition of operation of the gas turbine.

As will be seen from FIG. 2, each fuel nozzle ring 7A, 7B is provided with a fuel regulating valve 9A, 9B which enables the rates of supply of fuel from these nozzle rings 7A and 7B independently. It is therefore possible to freely control the radial distribution of the fuel concentration at the outlet of the premixing device.

The use of ring-type fuel nozzles is not essential. For instance, the same effects can be produced by arranging, as shown in FIG. 2, a plurality of rod-type nozzles 20A and 20B substantially along concentric circles of different diameters, with fuel supply lines connected to the fuel nozzles 20A of the radially inner circle and the fuel nozzles 20B on the radially outer circle through respective fuel regulating valves 21A and 21B.

Whether the ring-type nozzles 7A, 7B or the rod-type nozzles 20A, 20B are used can be determined depending on design demand. It is also possible to use both the ring-type nozzles 7A, 7B and the rod-type nozzles 20A, 20B simultaneously.

Figure 3:
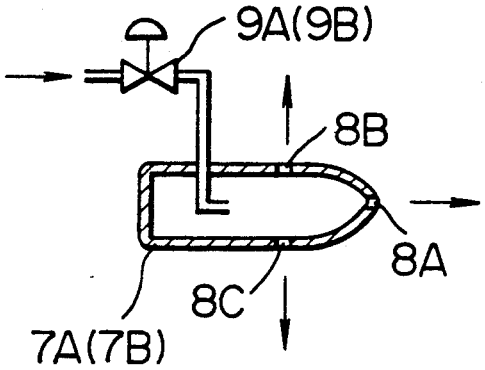
FIG. 3 is an enlarged sectional view of a fuel nozzle ring incorporated in the premixing device shown in FIG. 1.
Figure 4:
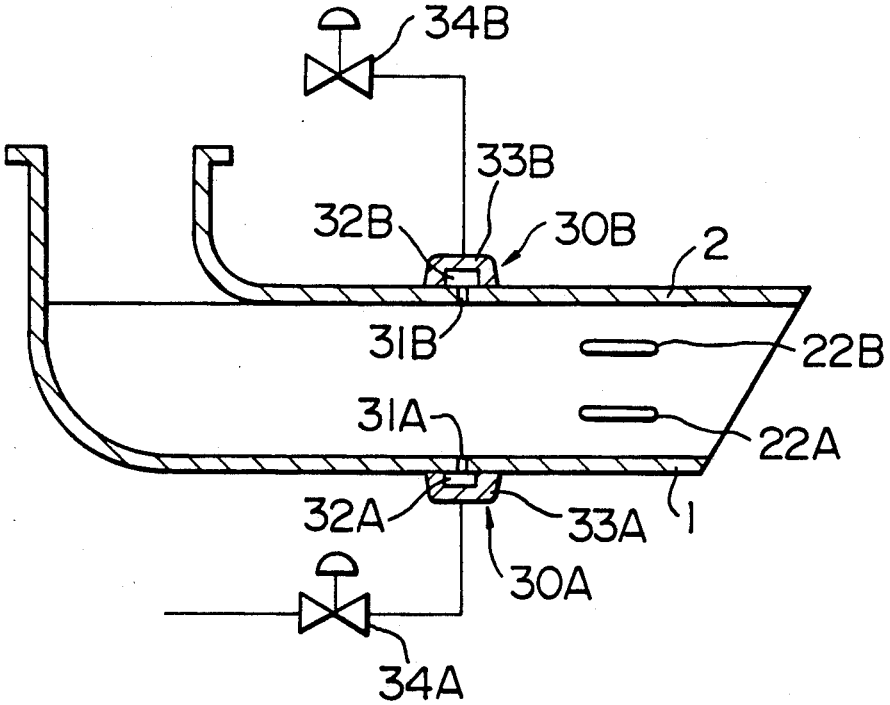
FIG. 4 is a sectional view of an essential portion of another embodiment of the premixing device of the present invention.

FIG. 4 shows another embodiment of the premixing device of the present invention in which fuel nozzle rings 30A, 30B provided by nozzle ports formed in the inner and outer cylinders 1 and 2 are used in place of the fuel nozzle rings 7A, 7B and/or the rod-type nozzles 20A, 20B explained in connection with FIGS. 1 to 3. More specifically, in the embodiment shown in FIG. 4, a plurality of nozzle ports 31A, 31B are formed in the walls of the inner and outer cylinders 1 and 2 at suitable circumferential pitches, and annular members 33A and 33B are attached to the walls of the respective cylinders 1 and 2 so as to define passages 32A and 32B which communicate with the respective nozzle ports 31A and 32B. The fuel is supplied to the passages 32A and 32B through respective fuel regulator valves 34A and 34B.

Figure 5:
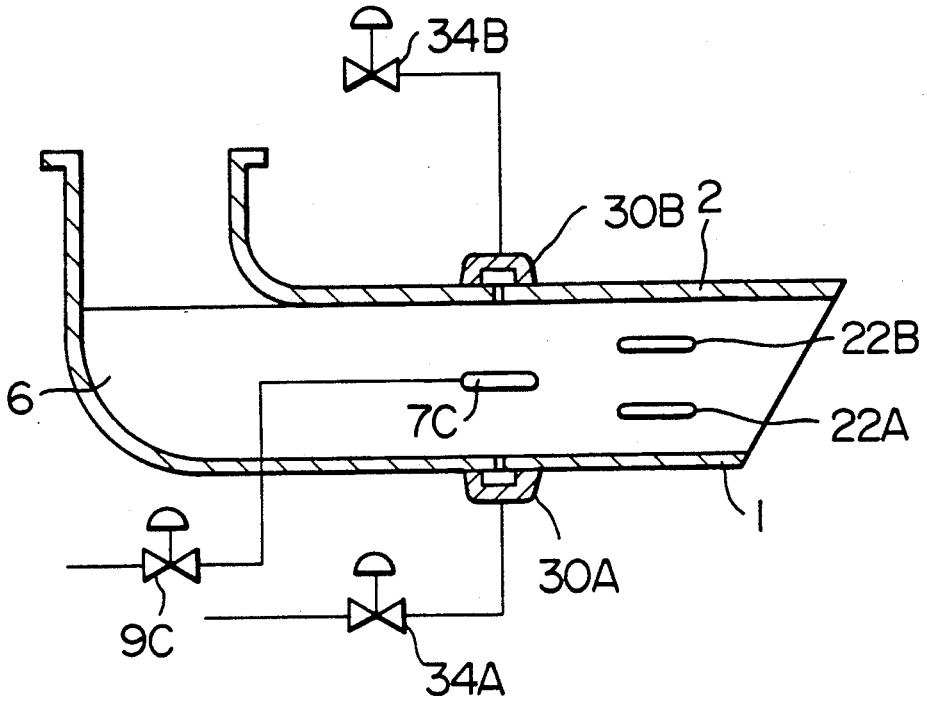
FIG. 5 is a sectional view of an essential portion of still another embodiment of the premixing device of the present invention.
Figure 6:
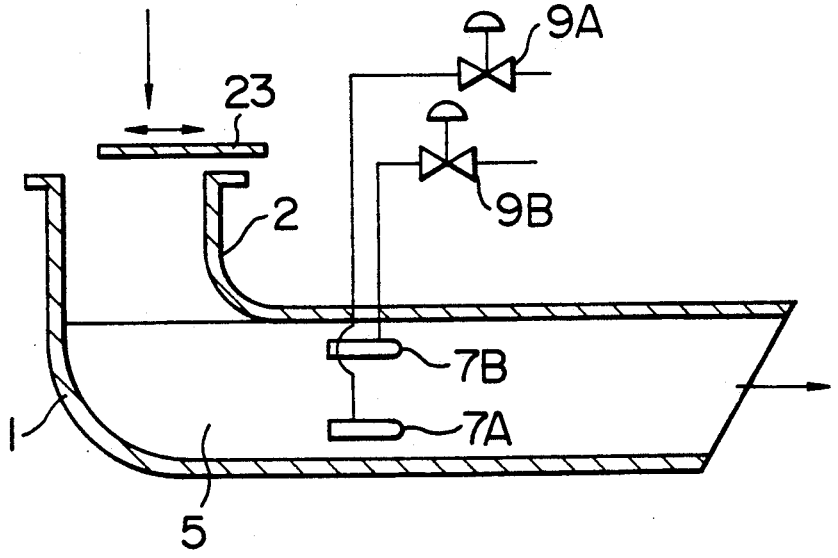
FIG. 6 is a sectional view of an essential portion of a further embodiment of the premixing device of the present invention which employs an air flow-rate control ring.

FIG. 5 shows still another embodiment in which a fuel nozzle ring 7C of the same type as that shown in FIG. 2 is disposed between the inner and outer cylinders 1 and 2, in addition to the nozzle rings 30A and 30B used in the embodiment shown in FIG. 4. The fuel nozzle ring 7C is supplied with the fuel through a fuel regulator valve 9C. In the embodiment shown in FIG. 5, therefore, it is possible to control the radial distribution of the fuel concentration at the outlet of the premixing device in a more exquisite manner because the rates of fuel supply are controlled at the radially inner, intermediate and outer portions of the fuel passages 6 by virtue of the provision of the nozzle rings 30A, 30B and the intermediate fuel nozzle ring 7C.

It will be understood that the fuel-air premixing device of the present invention can employ various types of nozzles including the fuel nozzle rings 7A, 7B, 7C, rod- type nozzles 20A, 20B and the fuel nozzle rings 30A, 30B provided by nozzle ports in the walls of the cylinders 1,2, independently or in the form of a combination of two or more types of these nozzles.

In the premixing device of the invention having the described constructions, the air is introduced radially inward through the flare portion into the cylindrical portion 4 which provides the outlet, as explained before in connection with FIGS. 1 to 3. This arrangement inherently has a problem that the velocity of the mixture at the outlet of the premixing device is not uniform in the radial direction. More specifically, the air introduced radially inwardly impinges upon the wall of the inner cylinder 1 and is deflected towards the outer peripheral portion, i.e., to the region near the outer cylinder 2, so that the flowing velocity of the mixture tends to be increased in the region near the outer peripheral portion of the premixing device. According to the invention, however, the radial distribution of the fuel concentration can be uniformalized despite any non-uniform radial distribution of the flowing velocity, by controlling the rates of supply of the fuel such that the radially outer fuel nozzle ring 7B discharges the fuel at a greater rate than the radially inner fuel nozzle ring 7A.

The fuel nozzle rings 7A, 7B disposed in the passages 6 can serve also as streaming members which settles the flow of the air flowing through the premixing device, so as to form a laminar flow, provided that the axial lengths of these fuel nozzle rings 7A, 7B are determined suitably. Such streaming members enhances the effect of uniformalizing the radial distribution of flowing velocity and, hence, of the radial fuel concentration distribution at the outlet of the premixing device.

It is possible to provide streaming plates 22A and 22B at the same radial positions as the fuel nozzle rings 7A and 7B as shown in FIGS. 1 and 2. The radial positions of the streaming members, however, may be suitably selected. For instance, the streaming members may be provided between the fuel nozzle ring 7A and the inner cylinder 1, between the fuel nozzle ring 7B and the outer cylinder 2, or between both fuel nozzle rings 7A and 7B.

In general, the burning of the pre-mixture formed by a premixing device is rather unstable so that it is a common measure to set a pilot flame (not shown) on the radially inner side of the premixing device, i.e., on the inner side of the inner cylinder 1. Usually, the pilot flame is a diffusion flame which is inherently stable. During partial or light load operation of the gas turbine, the pilot flame operates to burn fuel and, when the load has been increased beyond a predetermined level, the pilot flame ignites the pre-mixture at the outlet of the premixing device. The rate of supply of the pre-mixture and, hence, the burning rate of the pre-mixture are gradually increased as the load on the gas turbine is increased to full-load level.

The premixing device of the present invention can suitably be controlled to optimize the state of the pre-mixture at the outlet of the premixing device in response to change in the condition of operation, i.e., the level of the load, of the gas turbine.

For instance, when it is desired to ignite the pre mixture by the pilot flame, the ignition is facilitates by forming a pre-mixture which is richer in the radially inner region around the pilot flame than in the radially outer region. This can be realized by allowing the radially inner fuel nozzle ring 7A to supply the fuel at a rate greater than that from the radially outer fuel nozzle ring 7B, in case of the embodiment of FIG. 2. On the other hand, during full-load operation of the gas turbine, the rates of supply of the fuel from both fuel nozzle rings 7A and 7B are independently controlled so as to realize a uniform radial distribution of the fuel concentration at the outlet of the premixing device.

The premixing device of the present invention is required to meet a wide range of energy demand from the gas turbine. It is also required that ratio of premixing between the fuel and air is kept within a predetermined range in order that the burning of the pre-mixture formed by the premixing device be maintained stably. To cope with these requirements, it is possible to provide an air flow-rate control ring 23 at the air inlet of the premixing device as shown in FIG. 4, the air flow-rate control ring being axially movable so as to vary the area of the air inlet, thereby controlling the rate of supply of the air into the premixing device. When the air flow-rate control ring 23 is axially slided as shown in FIG. 4 in accordance with a reduction in the load on the gas turbine, the area of the air inlet is decreased in such a manner that the flow of air is concentrated to the region around the inner cylinder 1 so that a radial flow velocity distribution is obtained at the outlet of the premixing device such that the velocity is greater at the radially inner region of the premixing device than at the radially outer region of the same. In such a case, according to the invention, it is possible to optimize the radial distribution of the fuel concentration at the outlet of the premixing device by controlling the rates of supply of the fuel from both fuel nozzle rings 7A, 7B such that the radially inner fuel nozzle ring 7A delivers the fuel at a greater rate than the radially outer fuel nozzle ring 7B. When the pre-mixture at the outlet of the premixing device is ignited by the pilot flame during light-load operation of the gas turbine in which the fuel supply rat is small, the rate of supply of the air can be decreased correspondingly so as to maintain the fuel-to-air ratio within the predetermined range without causing any mis-fire.

As has been described, according to the present invention, it is possible to optimize the radial distributions of the flow velocity of the mixture and the fuel concentration at the outlet of the premixing device in accordance with conditions demanded by the gas turbine. For instance, the radial distributions of the flowing velocity and fuel concentration are uniformizing during operation of the gas turbine at a high load level, whereas, when it is desired to ignite the premixture with a pilot flame, the fuel-air mixture is enriched locally in the radially inner region around the pilot flame so as to facilitate the ignition. During operation of the gas turbine at a low load level, the radial distribution of the fuel concentration is uniformizing so as to stabilize the burning of the premixture over the entire load range of the gas turbine.

What is claimed is:

1. A fuel-air premixing device of a gas turbine of the type having a double-cylinder structure composed of an inner cylinder and an outer cylinder defining therebetween flow passages such that a fuel is supplied into air flowing through said passages so that a premixture of the fuel and air is formed and discharged, said premixing device comprising:

a plurality of radially spaced rod-type fuel nozzles each being provided with a plurality of nozzle ports oriented in a plurality of different directions for supplying said fuel into said passages, each of said rod-type nozzles being supported by said inner cylinder and arranged along a circle; and means for independently controlling the rates of supply of the fuel from said radially spaced rod-type nozzles.

2. A fuel-air premixing device according to claim 1, further comprising at least one plate means disposed in said passages for forming a laminar air flow through the premixing device.

3. A fuel-air premixing device according to claim 1, further comprising a slidable air flow-rate control ring provided at the air inlet of said passages.

* * * * *